US011540635B2

(12) United States Patent
Nishino

(10) Patent No.: US 11,540,635 B2
(45) Date of Patent: Jan. 3, 2023

(54) ROCKING CHAIR

(71) Applicant: SCIENCE ROAD INTERNATIONAL INC., Yokohama (JP)

(72) Inventor: Itaru Nishino, Yokohama (JP)

(73) Assignee: SCIENCE ROAD INTERNATIONAL INC., Yokohama (JP)

( * ) Notice: Subject to any disclaimer, the term of this patent is extended or adjusted under 35 U.S.C. 154(b) by 0 days.

(21) Appl. No.: 17/489,295

(22) Filed: Sep. 29, 2021

(65) Prior Publication Data

US 2022/0312970 A1 Oct. 6, 2022

(30) Foreign Application Priority Data

Apr. 5, 2021 (JP) ..... JP2021-064125

(51) Int. Cl.
*A47C 3/025* (2006.01)
*A47C 3/026* (2006.01)

(52) U.S. Cl.
CPC ..... *A47C 3/0257* (2013.01); *A47C 3/026* (2013.01)

(58) Field of Classification Search
CPC ..... A47C 3/18; A47C 3/0257; A47C 3/026; A47C 3/02; A47D 13/10
(Continued)

(56) References Cited

U.S. PATENT DOCUMENTS 229,733 A * 7/1880 Michaels ..... A47C 3/027 297/263.2
5,590,930 A 1/1997 Glockl
(Continued)

FOREIGN PATENT DOCUMENTS

EP 3925489 A1 * 12/2021
JP 7-503392 A 4/1995
(Continued)

*Primary Examiner* — Milton Nelson, Jr.

(74) *Attorney, Agent, or Firm* — Birch, Stewart, Kolasch & Birch, LLP

(57) ABSTRACT

Provided is a rocking chair having a seat body for a user to sit on, a support body for supporting the seat body from below, and a connecting mechanism provided between the seat body and the support body to move the seat body along a surface of a sphere centered on a base point above the seat body in response to an external force applied to the seat body. The connecting mechanism is composed of at least three sub-mechanisms, each of which has a circular track section on the support body side, a linear track section on the seat body side, and a connecting section to interlock their movements. The circular track section has a first traveling member and a first guiding member for traveling the first traveling member along a circle. The linear track section has a second traveling member and a second guiding member to make the second traveling member travel along a surface of a concentric sphere centered on the base point and in a linear manner when viewed from a direction parallel to a central axis of the circle wherein the first traveling member travels. The connecting section has a connecting member that is connected at both ends to a first retainer that holds the first traveling member and a second retainer that holds the second traveling member, and at least one of the first retainer and the second retainer is rotatably connected to the connecting member.

7 Claims, 7 Drawing Sheets

(58) Field of Classification Search
USPC ..... 297/259.1
See application file for complete search history.

(56) References Cited

U.S. PATENT DOCUMENTS

| | | | | |
|---|---|---|---|---|
| 8,182,036 | B2 | 5/2012 | Nishino | |
| 10,449,876 | B2 * | 10/2019 | Lonstein | B60N 2/2821 |
| 2019/0298064 | A1 * | 10/2019 | Shih | A47C 3/0255 |

FOREIGN PATENT DOCUMENTS

| | | | |
|---|---|---|---|
| JP | 2010-29646 | A | 2/2010 |
| JP | 2011-167532 | A | 9/2011 |

* cited by examiner

ROCKING CHAIR

TECHNICAL FIELD

The present invention relates to a rocking chair with a seat body for a user to sit on, a support body for supporting the seat body from below, and a connecting mechanism installed between the seat body and the support body for moving the seat body along a surface of a sphere centered on a base point located above the seat body in response to an external force applied to the seat body.

THE RELATED ART

As a rocking chair configured to move its seat body in response to a force applied to the seat body by a user, a chair using a convex surface that forms part of a surface of a sphere centered on a base point located above the seat body has been proposed (for example, Patent Document 1 (JP H7-503392 A) and Patent Document 2 (JP 2011-167532 A)).

Patent document 1 discloses an active dynamic seat device (rocking chair) with a seat part (seat body) for a user to sit on, a leg part (support body) for supporting the seat part, and an intermediate part (connecting mechanism) for rocking the seat part which is located between the seat part and the leg part (see FIGS. 1 to 3 of this document). The intermediate part has a dish-shaped seat shell that is convexly formed downward on the lower side of the seat part, and numerous rotating balls that are mounted along a horizontal circle on the upper side of the leg part and are in contact with a surface of the dish-shaped seat shell. The dish-shaped sheet shell is preferably formed to have the shape of part of a spherical surface. When an external force is applied to the seat part by a user, the seat shell is supported by the numerous balls and moves.

Patent Document 2 discloses a rocking chair equipped with a seat (seat body), a support body for supporting the seat, and a connecting mechanism for rocking the seat which is located between the seat and the support body. The connecting mechanism has a projecting member provided on the underside of the seat with a convex surface that is part of a surface of a sphere centered on a point (base point) above the seat, and at least three swivel casters with a roller in contact with the surface of the projecting member which are arranged at approximately equal intervals along a horizontal circle, and each swivel caster is attached to the support body so that its swivel axis passes through the center of the sphere (see FIG. 2 in this document). When an external force is applied to the seat by a user, the projecting member, and thus the seat on this projecting member, is supported by the swivel casters and moves along the spherical surface.

The rocking chair described in Patent Document 1 and the rocking chair described in Patent Document 2 commonly have structural elements (a seat shell and a projecting member) with a convex surface that form part of a spherical surface, but it is expensive to manufacture these structural elements with high accuracy. Therefore, some rocking chairs are known to have a first connecting mechanism for moving a seat body in one direction (for example, X-axis direction) relative to a support body and a second connecting mechanism for moving the seat body in the direction perpendicular to the above direction (for example, Y-axis direction) relative to the support body in order to achieve the above-mentioned purpose by interlocking these connecting mechanisms (see, for example, Patent Document 3 (JP 2010-029646 A)). In such rocking chairs, an intermediate body is generally provided between the seat body and the support body, and a two-stage configuration is adopted in which the first connecting mechanism is placed between the support body and the intermediate body, and the second connecting mechanism is placed between the intermediate body and the seat body.

Patent Document 3 discloses a rocking chair having a seat (seat body), a support body for supporting the seat, and a connecting member (connecting mechanism) for connecting the seat and the support body, wherein the connecting member comprises an intermediate member (intermediate body) between the seat and the support body, two downwardly curved first rails on the support body side, two downwardly curved second rails that is perpendicular to the first rails and provided on the seat side, two rows of first roller including two rollers that are able to travel along the first rail and two rows of second roller including two rollers that are able to travel along the second rail which are provided on the intermediate member (see FIGS. 5 and 6 of this document).

PRIOR ARTS DOCUMENTS

Patent Documents

Patent Document 1: JP H7-503392 A
Patent Document 2: JP 2011-167532 A
Patent Document 3: JP 2010-029646 A

SUMMARY OF THE INVENTION

Problems to be Solved by the Invention

As mentioned above, it is expensive to accurately manufacture the structural elements (a seat shell and a projecting member) with a convex surface that forms part of a spherical surface in the rocking chairs described in Patent Documents 1 and 2. Further, excessive rocking is avoided in the rocking chairs of Patent Documents 1 and 2 by colliding a rocking structure with a non-rocking structure, but the seat body may move unintentionally when a user is seated or stands up from the chair, which is expected to cause the user to lose balance and fall or stagger. Therefore, a means to avoid rocking (brake) is required, which is activated according to the usage status of the chair and the intention of the user. However, when the structural element with a convex surface that forms part of a spherical surface is used, it is difficult to install such a means to avoid rocking easily.

Also, the rocking chair described in Patent Document 3 requires the first connecting mechanism for moving the seat body in one direction (for example, X-axis direction) relative to the support body, the second connecting mechanism for moving the seat body in the direction perpendicular to the above direction (for example, Y-axis direction) and the intermediate body to realize these, which makes the structure complicated and the manufacturing cost high.

Therefore, the objective of the present invention is to provide a rocking chair with a simple structure that can rock a seat body along a surface of a sphere centered on a base point located above the seat body in response to an external force applied to the seat body, and that can be manufactured inexpensively.

Means for Solving Problems

As a result of intensive studies, the inventor has thought of a rocking chair with a novel connecting mechanism that has a sub-mechanism to interlock a traveling member in circular motion with a traveling member in linear reciprocating motion. Therefore, the present invention relates to a rocking chair comprising a seat body for a user to sit on, a support body for supporting the seat body from below, and a connecting mechanism installed between the seat body and the support body to move the seat body along a surface of a sphere centered on a base point located above the seat body in response to an external force applied to the seat body, wherein the connecting mechanism is composed of at least three sub-mechanisms that work together to achieve the movement of the seat body, and each of the sub-mechanisms comprises:

a circular track section having a first traveling member, and a first guiding member fixed to the support body for traveling the first traveling member along a circle, the first guiding member being arranged so that a central axis of the circle for traveling the first traveling member passes through the base point in a neutral position;

a linear track section having a second traveling member, and a second guiding member fixed to the seat body with a guide part for traveling the second traveling member, the guide part having an arc shape that coincides with a surface of a concentric sphere centered on the base point and that starts at a position between a contact point of the second traveling member with the guide part and a central point of the circle and extends linearly through the contact point when viewed from a direction parallel to the central axis of the circle in the neutral position;

and a connecting section for interlocking the traveling of the first traveling member with the traveling of the second traveling member having a connecting member placed between the first and second guiding members, a first retainer that is provided at one end of the connecting member and holds the first traveling member, and a second retainer that is provided at the other end of the connecting member and holds the second traveling member, the connecting member being arranged so that a central axis of the connecting member passes through the base point in the neutral position, at least one of the first retainer and the second retainer being rotatably connected to the connecting member.

As far as the present invention is concerned, the "neutral position" means the position occupied by each component in a rocking chair that is not in use. In the rocking chair of the present invention, the at least three sub-mechanisms that make up the connecting mechanism work together to move the seat body along the surface of the sphere centered on the base point, and "to move the seat body along the surface of the sphere centered on the base point" means to move the seat body so that an arbitrarily selected point of the seat body is always in contact with the spherical surface.

Each of the at least three sub-mechanisms that make up the connecting mechanism has the circular track section, the linear track section and the connecting section.

The circular track section in each sub-mechanism is located on the side of the support body and has the first traveling member and the first guiding member for traveling the first traveling member along the circle. The first guiding member is arranged so that the central axis of the circle for traveling the first traveling member passes through the base point in the neutral position. If the central axis of the circle is arranged to pass through the base point in the neutral position, the central axis of the circle will pass through the base point even when the seat body moves from the neutral position.

The linear track section in each sub-mechanism is located on the side of the seat body and has the second traveling member and the second guiding member with the guide part for traveling the second traveling member. The guide part of the second guiding member has the arc shape that coincides with the surface of the concentric sphere centered on the base point and that starts at the position between the contact point of the second traveling member with the guide part and the central point of the circle whereon the first traveling member travels and extends linearly through the contact point when viewed from a direction parallel to the central axis of the circle in the neutral position, in order to satisfy both the purpose of moving the seat body along the surface of the sphere centered on the base point and the purpose of linearly traveling the second traveling member when viewed from a direction parallel to the central axis of the circle.

The connecting section in each sub-mechanism is located between the circular track section and the linear track section and has the connecting member in which the first retainer holding the first traveling member and the second retainer holding the second traveling member are connected at both ends, and the central axis of the connecting member is arranged to pass through the base point in the neutral position. However, at least one of the first retainer and the second retainer need to be rotatably connected to the connecting member in order to interlock the traveling of the first and the second traveling members. The central axis of the connecting member is the central axis of rotation of the first retainer and/or the second retainer, which are rotatably connected to the connecting member. If the central axis of the connecting member is positioned so that it passes through the base point in the neutral position, the central axis of the connecting member will pass through the base point even when the seat body is moved from the neutral position.

In the rocking chair of the present invention equipped with the connecting mechanism having the at least three sub-mechanisms with the circular track section, the linear track section and the connecting section, the first traveling member is guided by the first guiding member to perform a circular motion along the circle with a predetermined axis as the central axis in the circular track section, and the second traveling member is guided by the guide part of the second guiding member to perform a linear reciprocating motion in the linear track section. In the connecting section, at least one of the first retainer that holds the first traveling member that is capable of making the circular motion and the second retainer that holds the second traveling member capable of making the linear reciprocating motion is rotatably connected to the connecting member, so through this connecting section, the first traveling member and the second traveling member move in an interlocked manner. Also, as the at least three sub-mechanisms in the connecting mechanism make concerted action, the seat body moves along the surface of the sphere centered on the base point in response to external forces applied to the seat body.

The connecting mechanism provided in the rocking chair of the present invention has a simple structure which can be manufactured inexpensively that achieves the objective of moving the seat body along the surface of the sphere centered on the base point in response to external forces applied to the seat body, without including a structural element that requires high manufacturing costs such as the structural element with the convex surface that forms part of the spherical surface shown in Patent Documents 1 and 2 and without adopting the two-stage configuration shown in Patent Document 3 that is composed of the first connecting mechanism to move the seat body in one direction (for example, X-axis direction) relative to the support body, the second connecting mechanism for moving the seat body relative to the support body in a direction perpendicular to the aforementioned direction (for example, Y-axis direction) and the intermediate member for realizing these mechanisms.

The first guiding member in the circular track section of the sub-mechanism may be equipped with a guide part having a ring shape for guiding the first traveling member, while the first guiding member may have a composition wherein the first guiding member in the circular track section has a pillar fixed to the support body and an arm rotatably connected to the pillar, the tip of the arm serves as the first traveling member in the circular track section and as the first retainer in the connecting section, and the connecting member of the connecting section is connected to the tip of the arm. In the latter configuration, the circular track section and the connecting section of the sub-mechanism can be manufactured simply and inexpensively by using a small number of components.

The range in which the seat body can be moved relative to the support body depends on the length of the guide part of the second guiding member in the linear track section of the sub-mechanism. If the guide part of the second guiding member in the linear track section has a starting point near the central point of the circle for traveling the first traveling member when viewed from a direction parallel to the central axis of the circle in the neutral position and has a length that is almost twice the length between the starting point and the contact point of the second traveling member with the guide part in the neutral position, the range in which the seat body can be moved relative to the support body can be maximized.

It is preferable that the at least three sub-mechanisms that make up the connecting mechanism are arranged at approximately equal intervals along a horizontal circle with a line passing through the base point as a central axis, since the seat body can be moved uniformly in any direction along the surface of the sphere centered on the base point. Also, the at least three sub-mechanisms that make up the connecting mechanism can be configured to have the first guiding member capable of traveling the first traveling member along one common circle. With this configuration, the size of the rocking chair can be reduced. Furthermore, it is easy to introduce a means to avoid rocking (brake) into the rocking chair of the present invention; for example, the movement of the seat body can be stopped by a means to avoid rocking that increases the friction between the second traveling member and the guide part of the second guiding member. Furthermore, the rocking chair can be used even more safely if there is a falling prevention means to prevent the second traveling member from separating from the guide part of the second guiding member in each of the sub-mechanisms.

Advantageous Effects of the Invention

The connecting mechanism placed between a seat body and a support body in the rocking chair of the present invention is a novel connecting mechanism with a sub-mechanism to interlock a traveling member in circular motion and a traveling member in linear reciprocating motion, and the connecting mechanism can be manufactured inexpensively with a simple structure. By cooperatively operating the at least three sub-mechanisms that make up the connecting mechanism, the seat body can be moved smoothly along a surface of a sphere centered on a base point located the seat body in response to an external force applied to the seat body.

DETAILED DESCRIPTION OF THE INVENTION

First Embodiment

Figure 1:
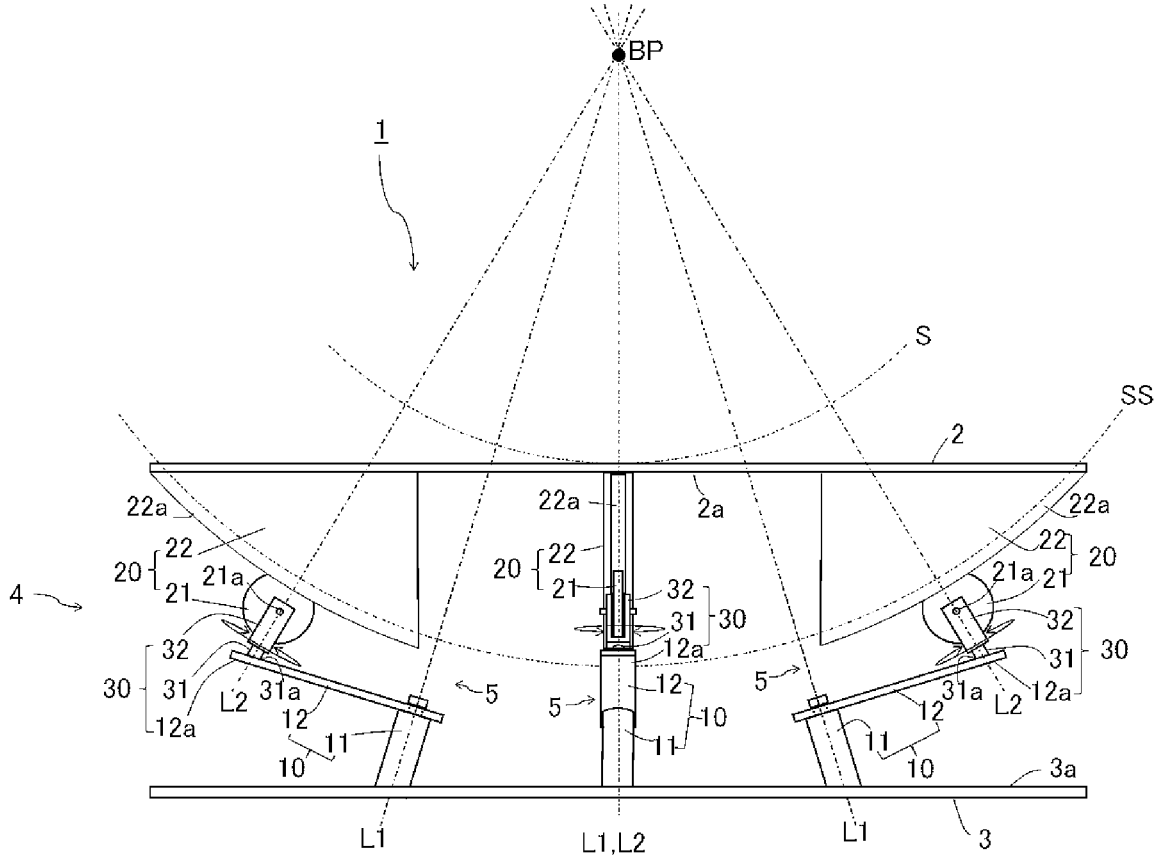
FIG. 1 is a schematic front view of a rocking chair in an embodiment of the present invention.

A rocking chair of the first embodiment of the present invention will be described below with reference to FIGS. 1 to 5. FIG. 1 is a schematic front view of the rocking chair 1 of this embodiment. The rocking chair 1 of this embodiment has a seat body 2 that is arranged horizontally, a support body 3 that is also arranged horizontally, and a connecting mechanism 4 to connect the seat body 2 and the support body 3 and to move the seat body 2 along a surface S of a sphere centered on a base point BP located above the seat body 2 in response to an external force applied to the seat body 2.

Figure 2:
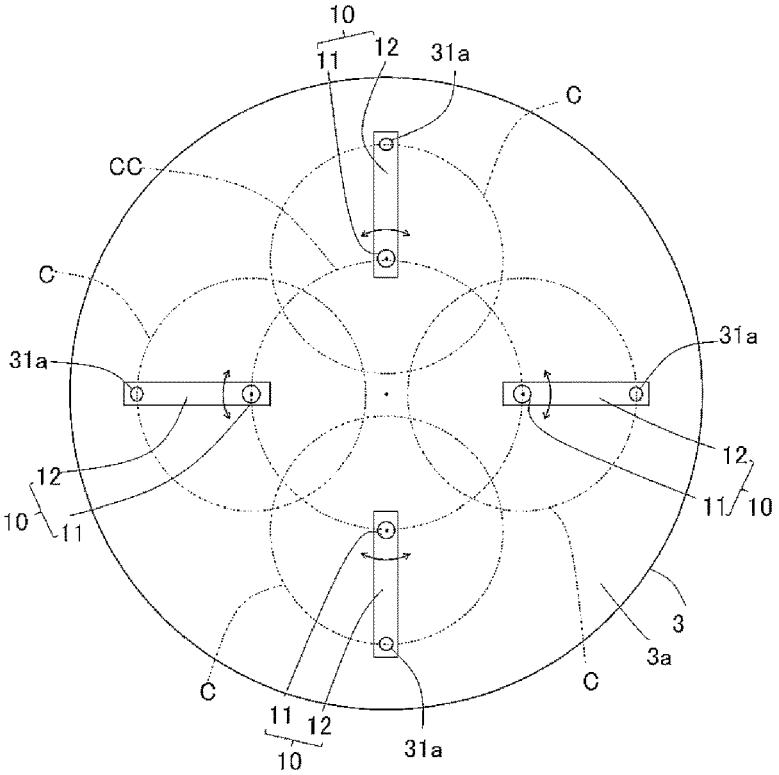
FIG. 2 is a schematic plan view showing the arrangement of circular track sections in sub-mechanisms that make up a connecting mechanism of the rocking chair in the embodiment shown in FIG. 1.
Figure 3:
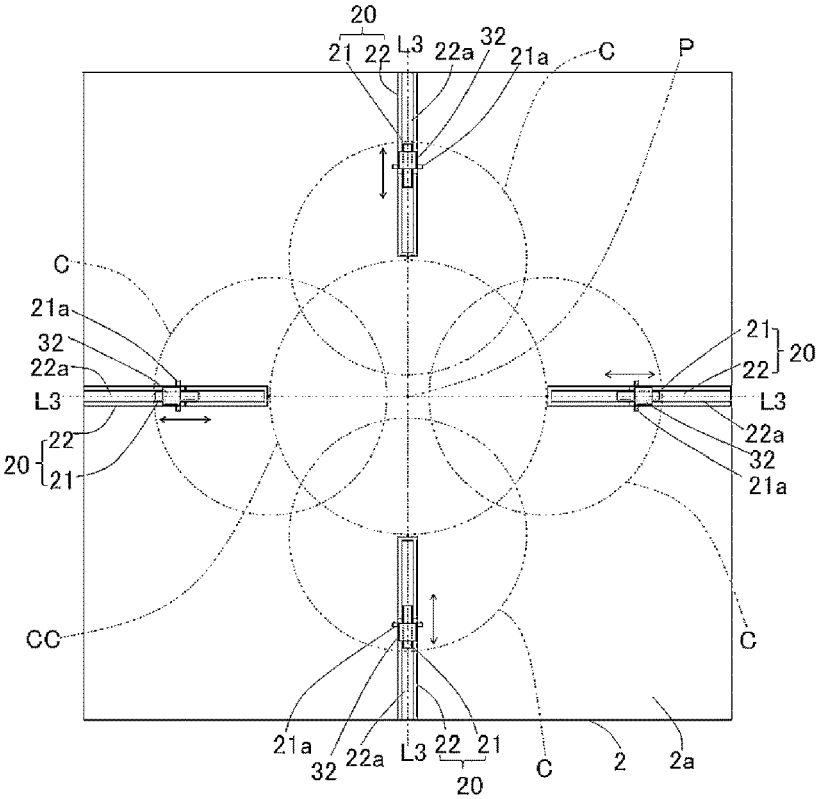
FIG. 3 is a schematic plan view showing the arrangement of linear track sections in sub-mechanisms that make up a connecting mechanism of the rocking chair in the embodiment shown in FIG. 1.

The connecting mechanism 4 is composed of four sub-mechanisms 5 (see FIGS. 2 and 3) that work together, and each sub-mechanism 5 is equipped with a circular track section 10 on the side of the support body 3, a linear track section 20 on the side of the seat body 2, and a connecting section 30 between the circular track section 10 and the linear track section 20. FIG. 2 is a schematic plan view of the support body 3 and the circular track sections 10 of all sub-mechanisms 5 that make up the connecting mechanism 4 that are viewed from the side of the circular track sections 10, and FIG. 3 shows a schematic plan view of the seat body 2 and the linear track sections 20 of all sub-mechanisms 5 that make up the connecting mechanism 4 that are viewed from the side of the linear track sections 20. FIGS. 1 to 3 show each component in the neutral position.

In the rocking chair 1 of this embodiment, the support body 3 is made of a circular plate as shown in FIGS. 1 and 2, and the seat body 2 is made of a square plate as shown in FIGS. 1 and 3, but these shapes are adopted only for the purpose of illustrating the operation of the connecting mechanism 4, and the shapes of the support body and the seat body may be appropriately chosen in accordance with the application. Also, as can be grasped from FIGS. 1 to 3, the four sub-mechanisms 5 which make up the connecting mechanism 4 in the rocking chair 1 of this embodiment are arranged at equal intervals along a horizontal circle CC with a line extending through the base point BP as a central axis.

As can be grasped from FIGS. 1 and 2, the circular track section 10 in each sub-mechanism 5 has a pillar 11 and an arm 12. The pillar 11, whose base end is fixed to the surface 3*a* facing the seat body 2 of the support body 3, has a cylindrical shape extending upward with a line L1 passing through the base point BP as its central axis (see FIG. 1). The arm 12, which is made of a rectangular plate, is rotatably connected to the tip side of the pillar 11 at its base end side. In the rocking chair 1 of this embodiment, the pillar 11 and the arm 12 make up a first guiding member, and the tip 12*a* of the arm 12 serves as a first traveling member guided by the first guiding member, the tip 12*a* of the arm 12 is guided by the pillar 11 and the arm 12 to perform a circular motion along a circle C (see FIG. 2) with the line L1 as a central axis. In the rocking chair 1 of this embodiment, the tip 12*a* of the arm 12 simultaneously plays the role of a first retainer in the connecting section 30 as described below.

As can be grasped from FIGS. 1 and 3, the linear track section 20 in each sub-mechanism 5 has a roller 21 that serves as a second traveling member and a second guiding member 22 for guiding the roller 21. The second guiding member 22 is fixed at its upper end to the surface 2*a* facing the support body 3 of the seat body 2, and has a guide part 22*a* at its lower end for accommodating the upper section of the roller 21 and guiding the roller 21. The guide part 22*a* has an arc shape that coincides with a surface SS of a concentric sphere centered at the base point BP above the seat body 2 (see FIG. 1), and that starts at a position near the center of the circle C in which the first traveling member travels and extends linearly through the contact point of the roller 21 and the guide part 22*a* when viewed from a direction parallel to the central axis L1 of the circle C in the neutral position (see FIG. 3). In FIG. 3, the straight line along which the guide part 22*a* follows is shown with the symbol L3, and the point where the respective lines L3 intersect is shown with the symbol P. The shaft 21*a* of the roller 21 is rotatably held by a second retainer 32 in the connecting section 30 described below, and thus, the roller 21 can be guided by the guide part 22*a* of the second guiding member 22 to reciprocate along the spherical surface SS and along the line L3. The length of the guide part 22*a* is almost twice the length between the starting point and the contact point.

As can be seen from FIG. 1, the connecting section 30 has a cylindrical connecting member 31, the tip 12*a* of the arm 12, which is provided at one end side of the connecting member 31 and serves as the first retainer, and the second retainer 32, which is provided on the other end side of the connecting member 31 and holds the roller 21 of the linear track section 20. The connecting member 31 extends so that its central axis L2 passes through the base point BP located above the seat body 2, and the tip 12*a* of the arm 12 is fixed to the connecting member 31. In FIG. 1 and FIG. 2, the symbol 31*a* is attached to the lower end of the connecting member 31, which is fixed to the tip 12*a* of the arm 12. The second retainer 32 holds the roller 21 so that its shaft 21*a* is parallel to the tangent surface of the spherical surface SS, that is, perpendicular to the line L2 passing through the base point BP, and is rotatably connected to the connecting member 31. Therefore, the shaft 21*a* of the roller 21 of the linear track section 20 can freely rotate via the second retainer 32 around the connecting member 31 as the axis of rotation. There arises no problem in the operation of the sub-mechanism 5 that make up the connecting mechanism 4 if the connecting member 31 is fixed to the second retainer 32 and rotatably connected to the tip 12*a* of the arm 12, or if the connecting member 31 is rotatably connected to both the second retainer 32 and the tip 12*a* of the arm 12.

Figure 4:
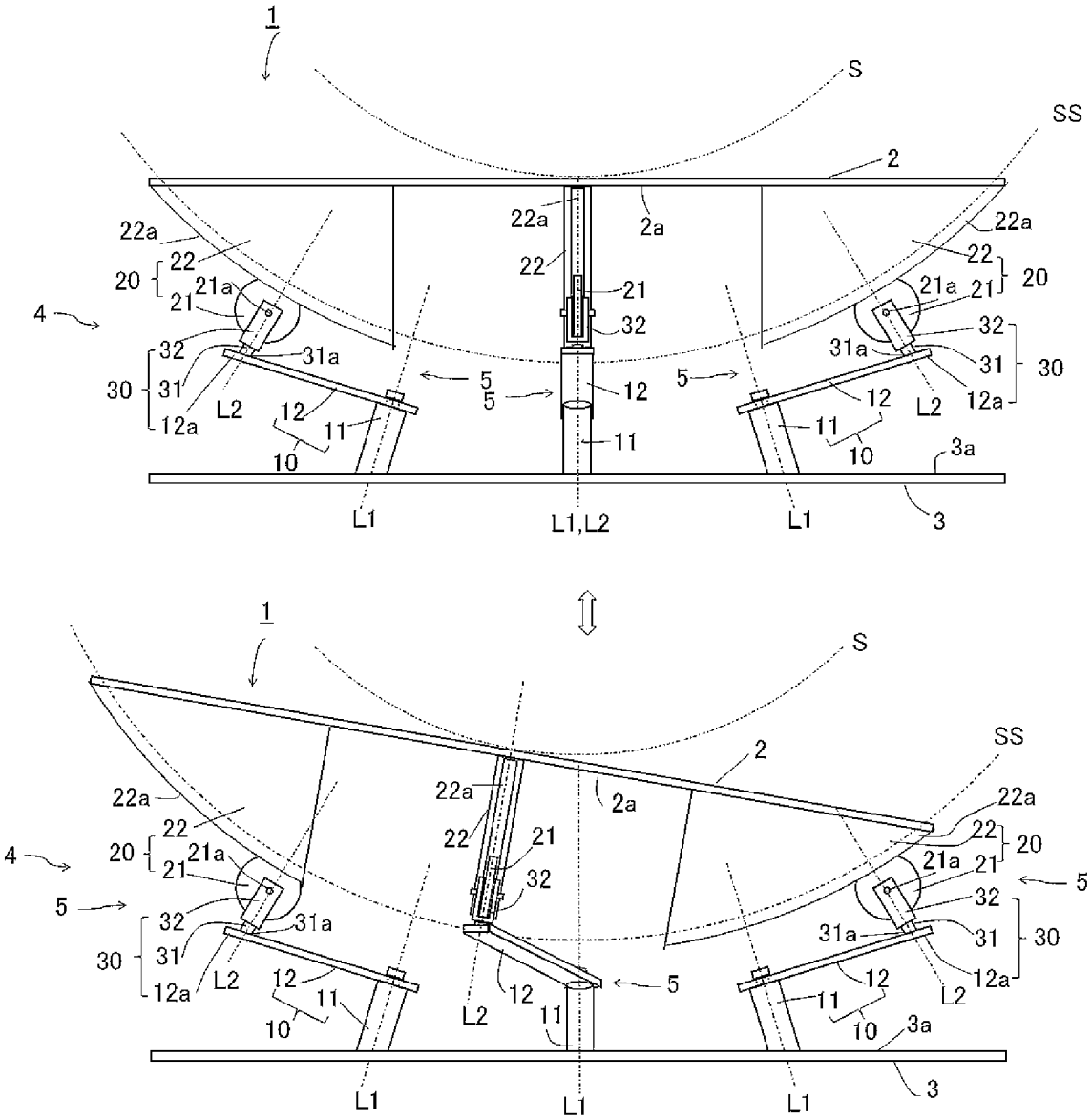
FIG. 4 is a diagram to illustrate the operation of the rocking chair shown in FIG. 1.
Figure 5:
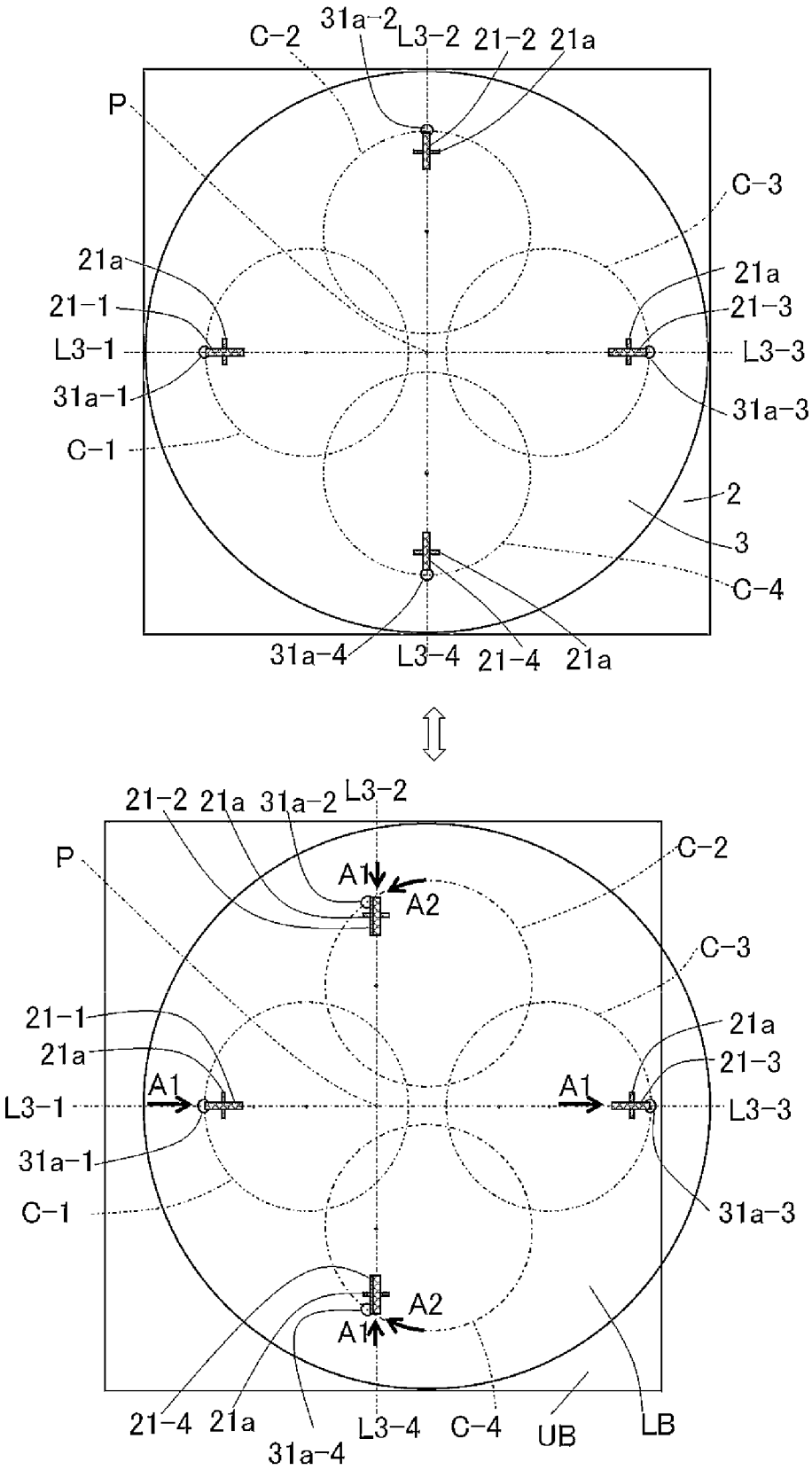
FIG. 5 is another diagram to illustrate the operation of the rocking chair shown in FIG. 1.

Next, the movement of the rocking chair 1 is explained using the explanatory diagrams in FIGS. 4 and 5. The upper diagram in FIG. 4 is a schematic front view corresponding to the neutral position of the rocking chair 1, and the lower diagram in FIG. 4 is a schematic front view showing the movement when a force in the horizontal plane is applied to the seat body 2 from the right side of the diagram (the right side when viewed from the front). The upper diagram in FIG. 5 is a schematic plan view corresponding to the upper diagram in FIG. 4, and the lower diagram in FIG. 5 is a schematic plan view corresponding to the lower diagram in FIG. 4. In the rocking chair 1 of this embodiment, the movement of the seat body 2 relative to the support body 3, and the movement of the tip 12*a* of the arm 12 fixed to the connecting member 31 of the connecting section 30 in the respective sub-mechanism 5 that make up the connecting mechanism 4 and the movement of the roller 21 rotatably held by the second retainer 32 that is rotatably connected to the connecting member 31 of the connecting section 30 in each sub-mechanism 5 for the purpose of achieving the relative movement of the seat body 2 to the support body 3 are important, so FIG. 5 only shows the support body 3, the seat body 2, the lower end 31*a* of the connecting member 31 that is fixed to the tip 12*a* of the arm 12 in each sub-mechanism 5 that make up the connecting mechanism 4, the roller 21, the line L3, the point P, and the circle C. For ease of understanding, the seat body 2 is shown as transparent and the roller 21 is decorated with a pattern in FIG. 5.

When a force in the horizontal plane is applied to the seat body 2 from the right side as shown in FIG. 5, the four sub-mechanisms 5 that make up the connecting mechanism 4 operate in conjunction with each other, in each sub-mechanism, the roller 21 rotatably held by the second retainer 32 that is rotatably connected to the connecting member 31 of the connecting section 30 is guided by the guide part 22*a* of the second guiding member 22 and moves in the direction of the arrow A1 in the lower diagram of FIG. 5, and simultaneously, the lower end 31*a* of the connecting member 31 is guided by the arm 12 that is rotatably connected to the pillar 11 and moves in the direction of arrow A2 in the lower diagram of FIG. 5. In other words, among the rollers 21, the roller 21-1 on the left side of the diagram travels along the line L3-1 and approaches the point P, the roller 21-3 on the right side of the diagram travels along the line L3-3 and moves away from the point P, and the remaining rollers 21-2 and 21-4 travel along lines L3-2 and L3-4, respectively, and move slightly closer to the point P. Also, among the lower ends 31*a* of the connecting members 31, the lower end 31*a*-1 on the left side of the diagram and the lower end 31*a*-3 on the right side of the diagram do not move from the neutral position, while the remaining lower ends 31*a*-2 and 32*a*-4 move along the corresponding circles C toward the left side of the diagram. As a result, since the guide part 22*a* of the second guiding member 22 has an arc shape along the surface SS of the concentric sphere centered on the base point BP located above the seat body 2, the seat body 2 is supported by the four sub-mechanisms 5 that move in conjunction with each other and moves along the spherical surface S to the left side of the diagram as shown in the lower diagram of FIG. 4.

In the rocking chair 1 of this embodiment, since the lower end 31*a* of the connecting member 31 of the connecting section 30 is fixed to the tip 12*a* of the arm 12, the lower end 31*a* can perform a circular motion along the circle C. Also since the second retainer 32 is rotatably connected to the connecting member 31, the roller 21 can travel along the line L3 while rotating around the connecting member 31 as the axis of rotation. As a result, the seat body 2 moves in the direction of the applied force along the spherical surface S relative to the support body 3. FIGS. 4 and 5 only show the movement of the seat body 2 when a force in the horizontal plane is applied to the seat body 2 from the right side of the diagram, but even when a force in the horizontal plane is applied to the seat body 2 from other directions, the seat body 2 is supported by the four sub-mechanisms 5 that work together in the same manner and moves in the direction of the applied force along the spherical surface S.

Second Embodiment

Figure 6:
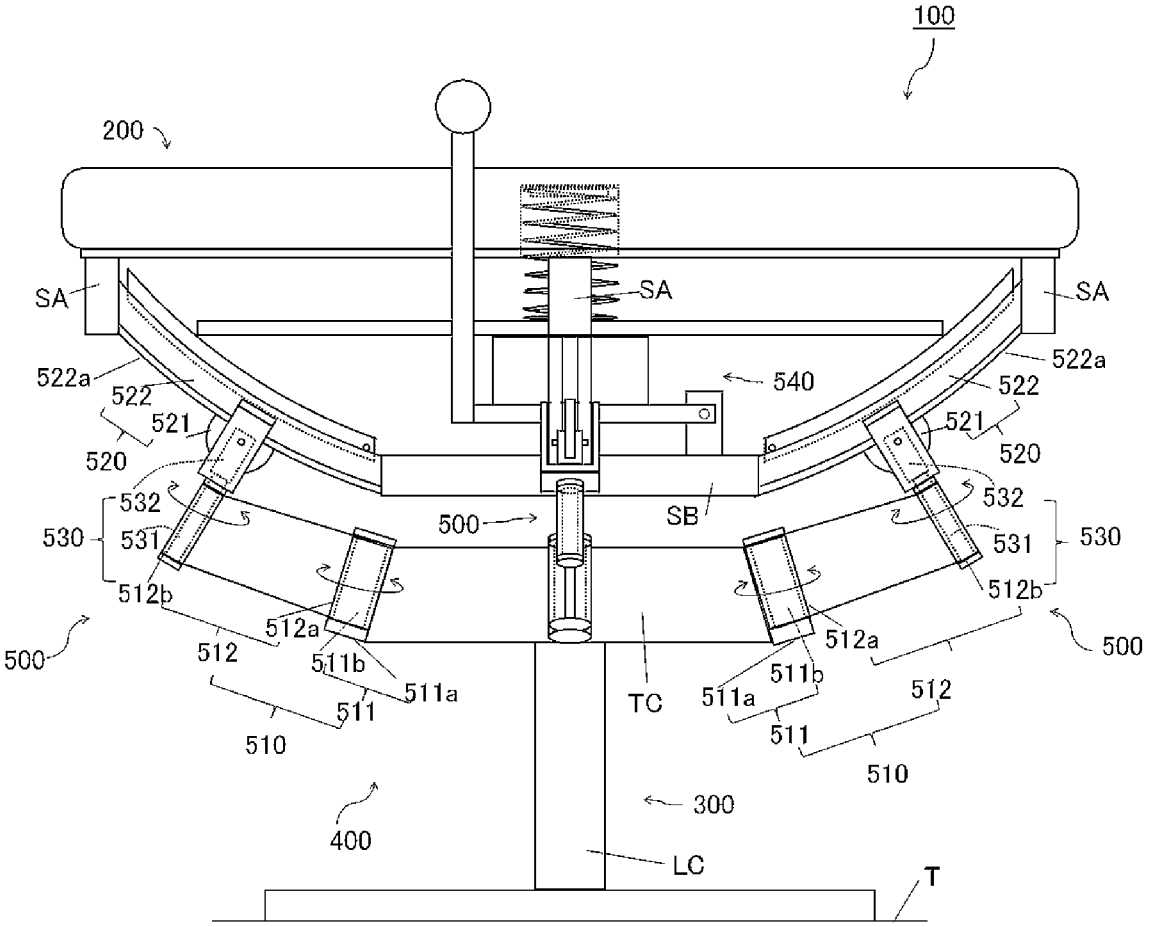
FIG. 6 is a schematic front view of a rocking chair with a connecting mechanism and a brake mechanism.

Next, a rocking chair 100 equipped with a brake mechanism (a means to avoid rocking) in addition to a connecting mechanism will be explained using FIGS. 6 and 7. FIG. 6 is a schematic front view of the rocking chair 100, which also shows the components in the neutral position. The rocking chair 100 has a seat body 200 for a user to sit on, support body 300 disposed on the floor T, a connecting mechanism 400 which is composed of four sub-mechanisms 500 that are disposed between the support body 300 and the seat body 200, and a brake mechanism 540 that is used when rocking should be avoided. The support body 300 has a cylindrical-shaped bearing part LC that extends perpendicular to the floor T, and a conical part TC that has a truncated cone shape and is located at the upper end of the bearing part LC.

The four sub-mechanisms 500 which make up the connecting mechanism 400 are arranged at approximately equal intervals along the circumference of the conical part TC of the support body 300, and each sub-mechanism 500 has a circular track section 510, a linear track section 520, and a connecting section 530. The circular track section 510 has a pillar 511 which has a pedestal 511*a* that is fixed to the circumference of the conical part TC and the cylinder-shaped column 511*b* extending from the pedestal 511*a* along the circumference of the conical part TC, and an arm 512 with cylindrical-shaped connections 512*a* and 512*b* at both ends. The central axis of the connection 512*a* and the central axis of the connection 512*b* are arranged so that they pass through a base point (not shown) located above the seat body 2 and on the central axis of the bearing part LC of the support body 300. The column 511*b* of the pillar 511 is passed inside the cylindrical connection 512*a* of the arm 512, and thus the arm 512 is rotatably connected to the column 511*b*. The connection 512*b* of the arm 512 is an element that serves as a traveling member (first traveling member) in the circular track section 510 and as a retainer (first retainer) that holds the first traveling member in the connecting section 530, and the connection 512*b* can move in a circular motion around the central axis of the column 511*b* of the pillar 511.

The linear track section 520 has a roller 521 that serves as a second traveling member and a second guiding member 522 for guiding the roller 521. The second guiding member has a guide part 522*a* having an arc shape that coincides with a surface of a concentric sphere centered on the base point (not shown) above the seat body 200 and on the central axis of the bearing part LC of the support body 300 and that extends linearly when viewed from a direction parallel to the central axis of the column 511*b*. One end of the second guiding member 522 is fixed to a fixed plate SA located at the edge of the seat body 200, and the other end of the second guiding member 522 is fixed to a fixed plate SB located above the conical part TC of the support body 300. The roller 521 can be guided by the guide part 522*a* of the second guiding member 522 and reciprocate. The structure of the second guiding member 522 will be described later.

The connecting section 530 is composed of a second retainer 532 that rotatably holds the roller 521, a cylindrical connecting member 531, and the connection 512*b* of the arm 512 that serves as the traveling member (first traveling member) in the circular track section 510 and as the retainer (first retainer) that holds the traveling member. The second retainer 532 is fixed to the upper end of the connecting member 531, the connecting member 531 is passed inside the cylindrical connection 512*b* of the arm 512, thus the connection 512*b* is rotatably connected to the connecting member 531.

Figure 7:
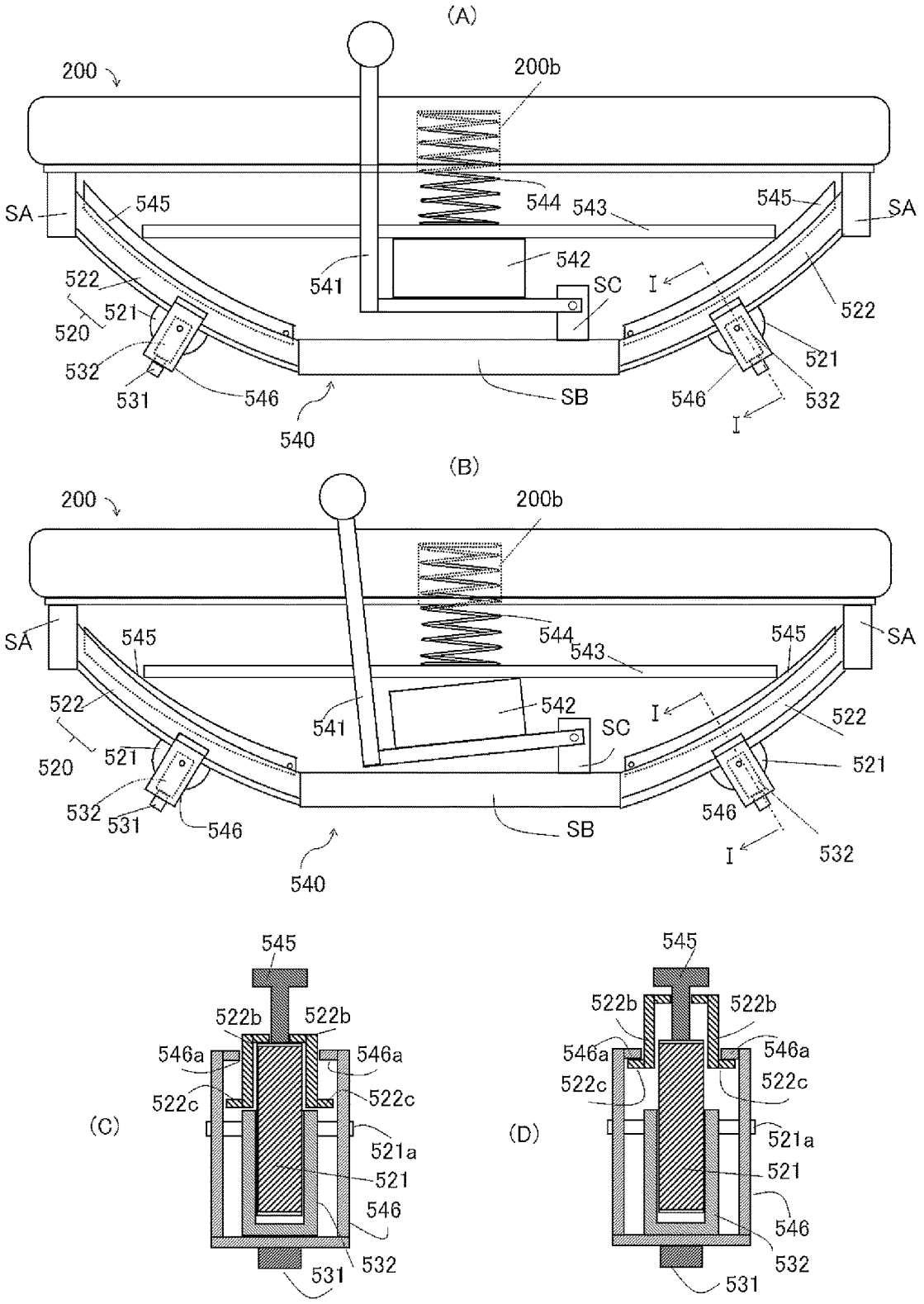
FIG. 7 is diagrams to illustrate the operation of the brake mechanism of the rocking chair shown in FIG. 6; (A) and (C) show the brake mechanism inactive, and (B) and (D) show the brake mechanism active.

FIG. 7 is a schematic diagram of the upper region of the rocking chair 100. For the purpose of explaining the brake mechanism 540, only the sub-mechanisms 500 on the left and right sides of the diagram are shown among the four sub-mechanisms 500 that make up the connecting mechanism 400 of the rocking chair 100. FIG. 7(A) shows the brake mechanism 540 in an inactive state, and FIG. 7(B) shows the brake mechanism 540 in an active state. FIG. 7(C) shows a schematic cross-sectional view on line I-I shown in FIG. 7(A), and FIG. 7(D) shows a schematic cross-sectional view on line I-I shown in FIG. 7(B). The second guiding member 522 of the linear track section 520 is composed of two parts 522*b* that are arranged in opposite directions and the lower end of a brake pad 545 that is arranged in the gap between the upper end side of these parts 522*b* so that the brake pad 545 can move vertically. The brake pad 545 is also a component of the brake mechanism 540. Furthermore, at the lower end of each of the two oppositely arranged parts 522*b*, the flange 522*c* that extends away from each other (see the schematic cross-sectional view in FIG. 7(*c*)) is placed.

The brake mechanism 540 is composed of a lever 541 for selecting activation or deactivation of the brake that is connected to a lever fixation member SC located on the fixed plate SB, a block member 542 that is fixed to the lever 541, a brake pressing plate 543 that is supported by the block member 542, a brake pressing spring 544, the lower end of which is fixed to the brake pressing plate 543 and the upper end of which is fixed to the bottom of a recess 200*b* placed in the center of the lower side of the seat body 200, the brake pad 545, and a cover 546 that is fixed to the connecting member 531 to enclose the second retainer 532 and has a shape similar to the second retainer 532. One end of the brake pad 545 is fixed to the second guiding member 522, and the upper surface of the brake pad 545 is in contact with the brake pressing plate 543, which is pressed downward by the brake pressing spring 544. Also, the upper end of the cover 546 has a protrusion 546*b* that extends in the direction toward the second guiding member 522. The shaft 521*a* of the roller 521 is rotatably connected to the cover 546 as well as the second retainer 532.

The movement of the seat body 200 relative to the support body 300 in response to a force applied to the seat body 200 by a user of the rocking chair 100 is the same as the movement described for the rocking chair 1 of the first embodiment, so the explanation concerning the movement of the seat body 200 relative to the support body 300 is omitted, and only the movement of the brake mechanism 540 will be explained here. When the user sitting on the seat body 200 of the rocking chair 100 in the state shown in (A) of FIG. 7 pushes down the lever 541 as shown in (B) of FIG. 7, the block member 542 fixed to the lever 541 tilts, and the brake push plate 543, which is pushed downward by the brake push spring 544, pushes the brake pad 545 downward. However, since the distance of the cover 546 from the floor T remains the same, the second guiding member 522, the fixed plate SA, the fixed plate SB, the brake mechanism 540 and the seat body 200 move upward until the protrusion 546*b* of the cover 546 collides with the flange 522*c* of the second guiding member 522 (see the schematic cross-sectional view in FIG. 7(D)). Therefore, the friction caused by the contact between the flange 522*c* and the protrusion 546*b* and the increased friction caused by the contact between the lower end of the brake pad 545 and the roller 521 stop the movement of the seat body 200 relative to the support body 300. The flange 522*c* and the protrusion 546*b* also serve as a means of preventing the seat body 200 from separating from the support body 300.

Third Embodiment

Figure 8:
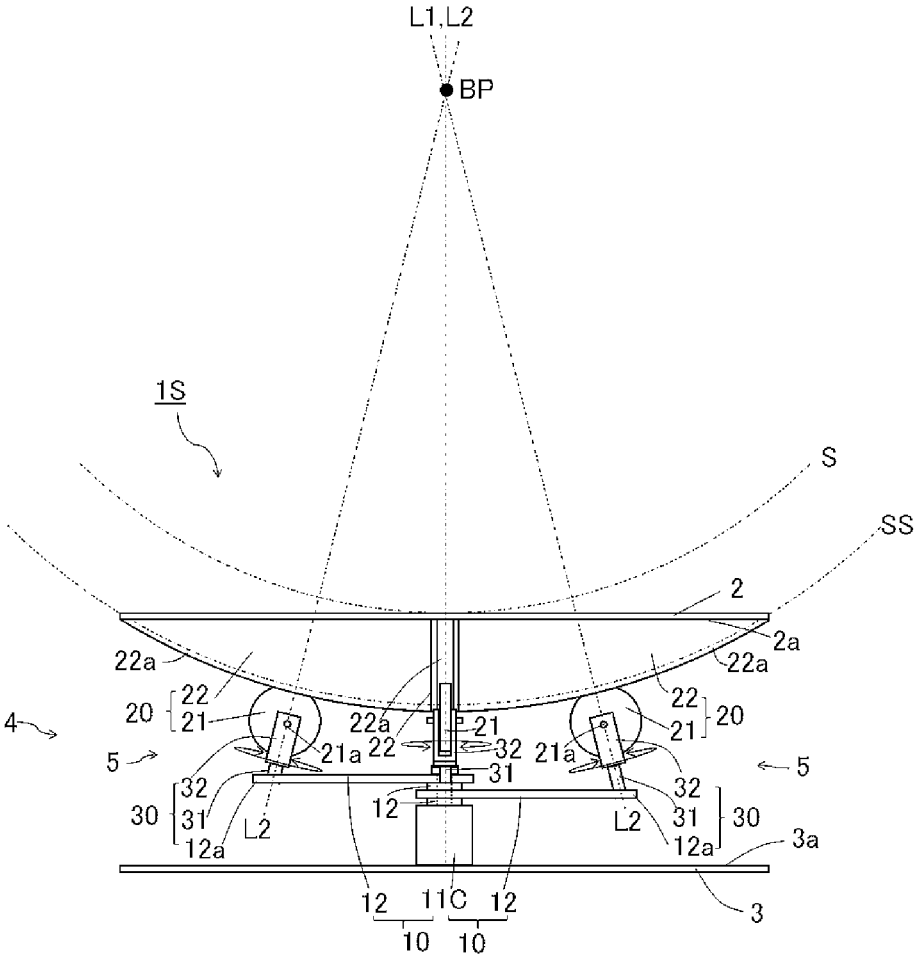
FIG. 8 is a schematic front view of another embodiment of a rocking chair of the present invention.

Next, the third embodiment of the rocking chair as a variation of the first rocking chair will be explained using FIG. 8. FIG. 8 shows a schematic front view of the rocking chair 1S of this embodiment, and this figure also shows each component in the neutral position. In this explanation, the same components as in the rocking chair 1 of the first embodiment are marked with the same sign to omit explanation, and the differences will be mainly explained.

The rocking chair 1S is characterized in that the circular track section 10 in each of the four sub-mechanisms 5 which make up the connecting mechanism 4 has a common pillar 11C, and is the most compact version of the rocking chair of the first embodiment. The central axis L1 of the common pillar 11C extends so that it passes through the base point BP located above the seat body 2, and the base end side of the arm 12 of each sub-mechanism 5 is rotatably connected to this common pillar 11C. Therefore, the tip 12*a* of the arm 12, which serves as the first traveling member in the circular track section 10 of each sub-mechanism 5, can travel along a common circle centered on the central axis L1 of the pillar 11C. In addition, the guide part 22*a* of the second guiding member 22 for guiding the roller 21 that serves as the second traveling member in the linear track section 20 of each sub-mechanism 5 has an arc shape that coincides with the surface SS of a concentric sphere centered on the base point BP and that extends linearly from the center of the common circle described above to the outside of this circle when viewed from a direction parallel to the central axis L1 of the pillar 11C in the neutral position. Furthermore, the central axis L2 of the connecting member 31 of the connecting section 30 in each sub-mechanism 5 also extends through the base point BP. The movement when a force in the horizontal plane is applied to the seat body 2 of this rocking chair 1S is the same as the motion shown in FIGS. 4 and 5, except that the tip 12*a* of the arm 12 in each sub-mechanism 5 moves along the common circle described above, so further explanation is omitted.

The above describes suitable embodiments of the rocking chair of the present invention. The present invention, however, is not limited to the embodiments, and can be modified within the scope of the invention indicated in the claims. For example, the arrangement of the at least three sub-mechanisms that make up the connecting mechanism of the rocking chair is not limited as long as the support body can support the seat body through the connecting mechanism in the process of using the rocking chair and the movement of one sub-mechanism does not interfere with the movement of the other sub-mechanisms. Also, the at least three sub-mechanisms that make up the connecting mechanism of the rocking chair do not all have to have the same shape; depending on the shape of the seat body and support body, for example, the set of sub-mechanisms with different lengths of arms may be used, or the set of sub-mechanisms with different spacing between the circular track section and the linear track section may be used. Further, it is not necessary for the guide parts of the second guiding member in all sub-mechanisms to have a shape that matches the same concentric sphere; the guide part in one sub-mechanism and the guide part in another sub-mechanism can have a shape that matches another concentric sphere with a different radius. Moreover, the first guiding members in the at least three sub-mechanisms that make up the connecting mechanism of the rocking chair are not limited to the form of the pillar and the arm that rotates around the pillar, but may also have a ring shape such as a circular guide rail, in which case the first traveling member may be like a guide block that runs on the circular guide rail, and the first retainer may be attached to the guide block and the connecting member in the connecting section may be connected to this first retainer. Furthermore, the second traveling members are not limited to the rollers shown in the embodiments, and the shape of the guide part of the second guiding member may be changed to a shape corresponding to the selected traveling member as long as the conditions shown in the claim are met.

INDUSTRIAL APPLICABILITY

The present invention provides a rocking chair with a simple structure that can be manufactured inexpensively.

DESCRIPTION OF THE REFERENCE NUMERALS

1, 1S, 100 Rocking chair
2, 200 Seat body
3, 300 Support body
4, 400 Connecting mechanism
5, 500 Sub-mechanism that makes up the connecting mechanism
10, 510 Circular track section
11, 11C, 511*b* Pillar in first guiding member
12, 512 Arm in first guiding member
12*a*, 512*b* Tip of the arm (First traveling member)
20, 520 Linear track section
21, 521 Roller (Second traveling member)
22, 522 Second guiding member
22*a*, 522*a* Guide part
30, 530 Connecting section
31, 531 Connecting member
12*a*, 512*b* Tip of the arm (First retainer)
32, 532 Second retainer
BP Base point
S, SS Surface of sphere centered on the base point

What is claimed is:

1. A rocking chair comprising a seat body for a user to sit on, a support body for supporting the seat body from below, and a connecting mechanism installed between the seat body and the support body to move the seat body along a surface of a sphere centered on a base point located above the seat body in response to an external force applied to the seat body, wherein the connecting mechanism is composed of at least three sub-mechanisms that work together to achieve the movement of the seat body, and each of the sub-mechanisms comprises:

a circular track section having a first traveling member, and a first guiding member fixed to the support body for traveling the first traveling member along a circle, the first guiding member being arranged so that a central axis of the circle passes through the base point in a neutral position;

a linear track section having a second traveling member, and a second guiding member fixed to the seat body with a guide part for traveling the second traveling member, the guide part having an arc shape that coincides with a surface of a concentric sphere centered on the base point and that starts at a position between a contact point of the second traveling member with the guide part and a central point of the circle and extends linearly through the contact point when viewed from a direction parallel to the central axis of the circle in the neutral position;

and a connecting section for interlocking the traveling of the first traveling member with the traveling of the second traveling member having a connecting member placed between the first and second guiding members, a first retainer that is provided at one end of the connecting member and holds the first traveling member, and a second retainer that is provided at the other end of the connecting member and holds the second traveling member, the connecting member being arranged so that a central axis of the connecting member passes through the base point in the neutral position, at least one of the first retainer and the second retainer being rotatably connected to the connecting member.

2. The rocking chair according to claim 1, wherein the first guiding member in the circular track section comprises a pillar fixed to the support body and an arm that is rotatably connected to the pillar, a tip of the arm serves as the first traveling member in the circular track section and as the first retainer in the connecting section, and the connecting member of the connecting section is connected to the tip of the arm.

3. The rocking chair according to claim 1, wherein the guide part of the second guiding member in the linear track section has a starting point near the central point of the circle when viewed from a direction parallel to the central axis of the circle in the neutral position and has approximately twice the length between the starting point and the contact point of the second traveling member with the guide part in the neutral position.

4. The rocking chair according to claim 1, wherein the at least three sub-mechanisms are arranged at approximately equal intervals along a horizontal circle with a line passing through the base point as a central axis.

5. The rocking chair according to claim 1, wherein the at least three sub-mechanisms are configured to have the first guiding member capable of traveling the first traveling member along a common single circle.

6. The rocking chair according to claim 1, wherein a means to avoid rocking is provided to stop the movement of the seat body by increasing friction between the second traveling member and the guide part of the second guiding member.

7. The rocking chair according to claim 1, wherein a means to prevent the second traveling member from separating from the guide part of the second guiding member is provided.

* * * * *